US009321567B2

(12) United States Patent
Daggett et al.

(10) Patent No.: US 9,321,567 B2
(45) Date of Patent: Apr. 26, 2016

(54) CLOSURE WITH TAMPER EVIDENT PUSH-PULL TETHER

(71) Applicants: Barry Daggett, Austintown, OH (US); Brian David Groubert, Boardman, OH (US)

(72) Inventors: Barry Daggett, Austintown, OH (US); Brian David Groubert, Boardman, OH (US)

(73) Assignee: Weatherchem Corporation, Twinsburg, OH (US)

( * ) Notice: Subject to any disclaimer, the term of this patent is extended or adjusted under 35 U.S.C. 154(b) by 66 days.

(21) Appl. No.: 13/839,887

(22) Filed: Mar. 15, 2013

(65) Prior Publication Data

US 2014/0217098 A1 Aug. 7, 2014

Related U.S. Application Data

(60) Provisional application No. 61/762,236, filed on Feb. 7, 2013.

(51) Int. Cl.

| | |
|---|---|
| ***B65D 43/10*** | (2006.01) |
| ***B65D 51/20*** | (2006.01) |
| ***B65D 47/10*** | (2006.01) |
| ***B65D 47/08*** | (2006.01) |

(52) U.S. Cl.

CPC ..... *B65D 47/0804* (2013.01); *B65D 47/10* (2013.01); *Y10T 29/49826* (2015.01)

(58) Field of Classification Search

CPC .... B65D 47/103; B65D 51/20; B65D 17/163; B65D 47/36

USPC ..... 220/259.1, 254.1, 266, 255.1, 269, 276, 220/359.2, 258.1, 258.2, 258.3, 254.3; 222/541.9, 235, 255; 215/250, 256, 215/305

See application file for complete search history.

(56) References Cited

U.S. PATENT DOCUMENTS

| | | | | |
|---|---|---|---|---|
| 3,282,477 | A * | 11/1966 | Henchert | 222/541.9 |
| 4,682,702 | A * | 7/1987 | Gach | 222/541.9 |
| 4,819,819 | A * | 4/1989 | Robertson, Jr. | 215/230 |
| 5,133,486 | A * | 7/1992 | Moore et al. | 222/541.9 |
| 6,360,909 | B1 | 3/2002 | Bridge | |
| 8,474,651 | B2 * | 7/2013 | Simkins | 221/63 |
| 8,813,982 | B2 * | 8/2014 | Van Geel et al. | 215/245 |
| 2001/0054616 | A1 * | 12/2001 | Ramsey et al. | 220/258 |
| 2014/0027457 | A1 * | 1/2014 | Wei | 220/258.3 |

* cited by examiner

*Primary Examiner* — Shawn M Braden

(74) *Attorney, Agent, or Firm* — Amin, Turocy & Watson, LLP

(57) ABSTRACT

A closure comprising a main portion and a flip-top portion are provided. The main portion comprises a tab and at least one rib. The flip-top portion is operatively connected to the main portion and is movable with respect to the main portion. The tab can be configured to break at least partially away from the at least one rib as a result of downward force applied to the tab. The at least one rib can be configured to spiral partially away from the tab and the main portion when the tab is pulled in an upward direction away from the main portion. The tab and the at least one rib comprise a tamper evident seal.

19 Claims, 10 Drawing Sheets

CLOSURE WITH TAMPER EVIDENT PUSH-PULL TETHER

CROSS-REFERENCE TO RELATED APPLICATIONS

This application claims the benefit of U.S. Provisional Application Ser. No. 61/762,236, filed Feb. 7, 2013, and entitled "CLOSURE WITH TAMPER EVIDENT PUSH-PULL TETHER", the entirety of which is expressly incorporated herein by reference.

TECHNICAL FIELD

The following description relates generally to a closure and, also generally, to a closure with a tamper evident push-pull tether.

BACKGROUND

Dispensing closures (sometimes referred to as caps or lids) can be utilized with containers (e.g., bottles, jars, cans, and so forth) as a single unit where the closure and the container are one piece or as separate units where the closure and the container are separate pieces. Further, the closures and containers can be used with a wide variety of products such as, for example, food items, powders, granular items, fertilizers, grass seed, and other non-food items, such as hardware (e.g., screws, nails, bolts, and so forth), and/or other items. The lack of an easy to open closure and/or lack of an easy to use closure have been blamed for user dissatisfaction.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

An aspect relates to a closure comprising a main portion and a flip-top portion. The main portion comprises a tab and at least one rib. The flip-top portion is operatively connected to the main portion and is movable with respect to the main portion. In an example, a location of the tab is at about a center of an opening of the main portion, wherein the opening corresponds with a mouth of a container.

According to an implementation, the at least one rib comprises a spiral element that at least partially encloses at least a portion of the tab. In accordance with another implementation, the at least one rib comprises a spiral element that at least partially encircles the tab at least once. According to some implementations, the at least one rib comprises a spiral element that at least partially surrounds the tab at least twice.

According to some implementations, the tab is configured to break partially away from the at least one rib as a result of downward force applied to the tab. In an implementation, the at least one rib is configured to spiral partially away from the tab and the main portion when the tab is pulled in an upward direction away from the main portion. According to some implementations, the tab and the at least one rib comprise a tamper evident seal. In accordance with one or more implementations, the tab and the at least one rib are irreversibly removable from the main portion.

Another aspect relates to a method for fabricating a container cap. The method comprises forming a lid portion and forming a body portion comprising an integrated tamper evident seal. The method also comprises connecting the lid portion and the body portion. In accordance with an implementation, the container and the dispensing closure are molded as a one piece unit.

According to an implementation, forming the body portion comprises forming a push tab comprising an attached tether portion. According to another implementation, forming the body portion comprises creating a spiral tab on an interior section of the body portion. In accordance with another implementation, forming the body portion comprises forming a spiral tab including portions formed of thin sections of material.

To the accomplishment of the foregoing and related ends, one or more aspects comprise features hereinafter fully described and particularly pointed out in the claims. The following description and annexed drawings set forth in detail certain illustrative features of one or more aspects. These features are indicative, however, of but a few of various ways in which principles of various aspects may be employed. Other advantages and novel features will become apparent from the following detailed description when considered in conjunction with the drawings and the disclosed aspects are intended to include all such aspects and their equivalents.

BRIEF DESCRIPTION OF THE DRAWINGS

Various non-limiting embodiments are further described with reference to the accompanying drawings in which.

DETAILED DESCRIPTION

Figure 1:
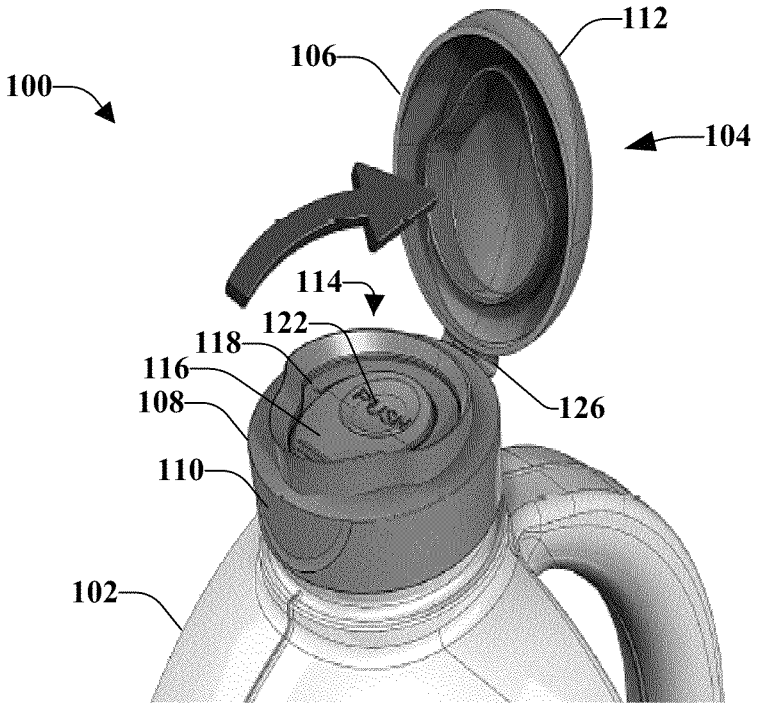
FIG. 1 illustrates an example, non-limiting embodiment of a container assembly, according to an aspect.

Various aspects are now described with reference to the drawings, wherein like reference numerals are used to refer to like elements throughout. In the following description, for purposes of explanation, numerous specific details are set forth in order to provide a thorough understanding of one or more aspects. It may be evident, however, that the disclosed subject matter can be practiced without these specific details, or with other methods, components, materials, and so forth.

As discussed above, dispensing closures and associated containers can be utilized with a vast variety of products, which can be in any number of forms (e.g., liquid, powder, solid, and so on). In some cases, a liner or other means of providing tamper evidence functionalities is used in addition to a dispensing closure. Removal of the dispensing closure and liner might not be easy and can result in user frustration.

For example, the container can hold various products, such as vitamins or liquids. In the case of vitamins or other first aid products (e.g., aspirin), a liner can be placed over the mouth of the container and sealed to a rim of the container to prevent tampering of the product contained therein. The liner has to be peeled back from the rim in order to gain access to the container contents. If the liner has been damaged or removed, it can indicate that someone has tampered with the product. However, it might be easy for someone to carefully peel back the liner (but not completely remove the liner from the container) and, after adding, removing, and/or tampering with items in the container, replace the liner and cap on the container. When a person purchases the product, it might not be easy to determine whether the liner did not completely seal with the container during manufacturing (and there has been no tampering with the product) or whether the product was in fact tampered with, which can have drastic consequences.

To overcome such uncertainty with the use of a liner, in accordance with some aspects, provided is a dispensing closure that can be manufactured in a manner that eliminates use of a liner (e.g., uses a non-liner container) while still providing tamper evidence capabilities. According to an implementation, prior to removal of a tamper evident seal integrated with the dispensing closure, the container can be hermetically sealed. In order to gain access to the container contents, the tamper-evident seal can be irreversibly removed from the dispensing closure. After removal of the tamper evident seal, a lid of the dispensing closure can be selectively opened and closed to access the container contents.

According to an aspect, a dispensing closure can comprise a main portion and a flip-top portion. The main portion can comprise a push-pull tether that can be attached to the dispensing closure to prevent product from being accessed before the product reaches the end user. When the end user desires to access the container contents, the push-pull tether can be removed, exposing the mouth or opening of the container to enable access of the container contents. The push-pull tether can be discarded (e.g., recycled). When the desired amount of product has been dispensed from the container, the flip-top portion can be moved into a closed position over the main body portion.

Turning to the figures, FIG. 1 illustrates an example, non-limiting embodiment of a container assembly 100, according to an aspect. Container assembly 100 includes a container portion 102 and a dispensing closure 104. The container portion 102 can be configured to accept and retain product or contents, which can be in liquid form, powdered form, solid form, or any other form. Further, the container contents can be various sizes and the disclosed aspects are not limited to a particular form or size of the product. The dispensing closure 104 can be configured to securely engage over the container portion 102 in a manner that retains the contents within the container portion 102.

Although the dispensing closure 104 is illustrated attached to the container portion 102, according to various aspects, the dispensing closure 104 can be selectively removable from the container portion 102. According to an embodiment, the container portion 102 and the dispensing closure 104 can be formed as separate pieces. For example, the container portion 102 and the dispensing closure 104 can be formed using separate molds in an injection molding process(es). In another example, the container portion 102 and the dispensing closure 104 can be formed using different cavities in a single mold. However, according to some aspects, the container portion 102 and the dispensing closure 104 can be formed as a single piece. For example, the container portion 102 and the dispensing closure 104 can be formed with a single cavity in a mold. Further to the above examples, multiple container portions, dispensing closures, and/or one-piece container portion/dispensing closure combinations can be formed during a single cycle of an injection molding process (e.g., the mold comprises multiple cavities). Further, although a container portion 102 is illustrated as including a handle and/or other details, container portions that do not include handles and/or other illustrated details can be utilized with the disclosed aspects.

Dispensing closure 104 can include a lid portion or flip-top portion 106 and a main portion 108. The flip-top portion 106 can be configured to selectively cover the main portion 108 when access to contents contained in the container portion 102 is not needed (e.g., closure is closed). The flip-top portion 106 can also be selectively moved away from the main portion 108 when contents within the container portion 102 are to be accessed, as illustrated by the directional arrow in FIG. 1.

An indented area 110 on the main portion 108 corresponds with a thumb tab 112 on the flip-top portion 106. When access to the container contents is desired, an end user can push upward on the thumb tab 112 by placing the thumb (finger, portion of a hand or arm, or another object) into the indented area 110 located under the thumb tab 112. The upward movement on the thumb tab 112 can be performed using a single hand (e.g., using a thumb), for example.

Figure 2:
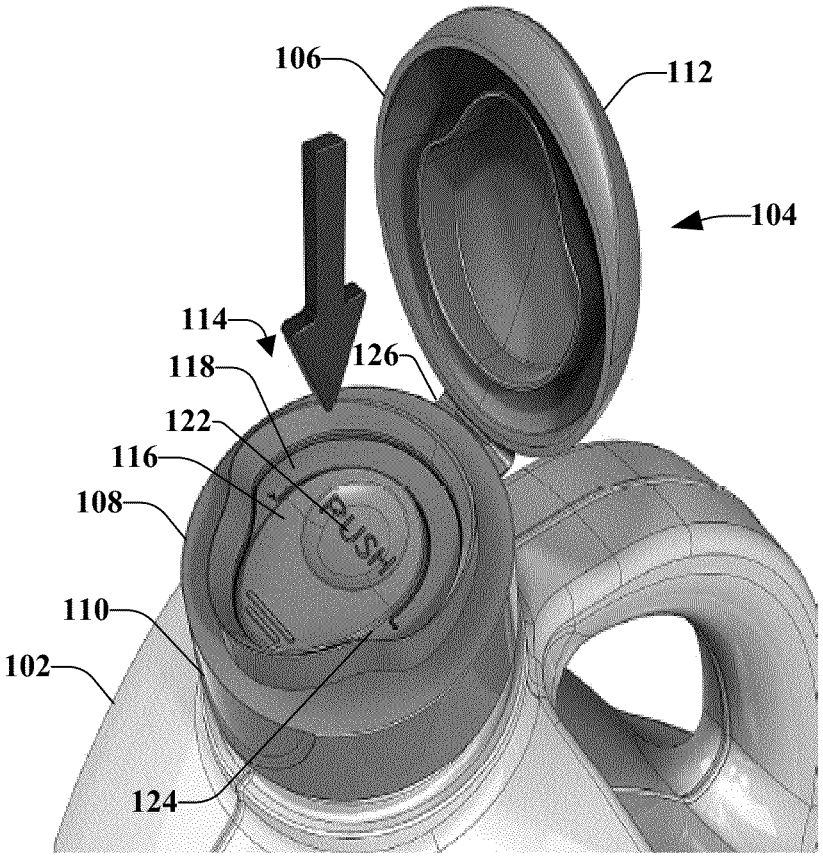
FIG. 2 illustrates an example, non-limiting embodiment of breakage of a tamper evident seal, according to an aspect.
Figure 3:
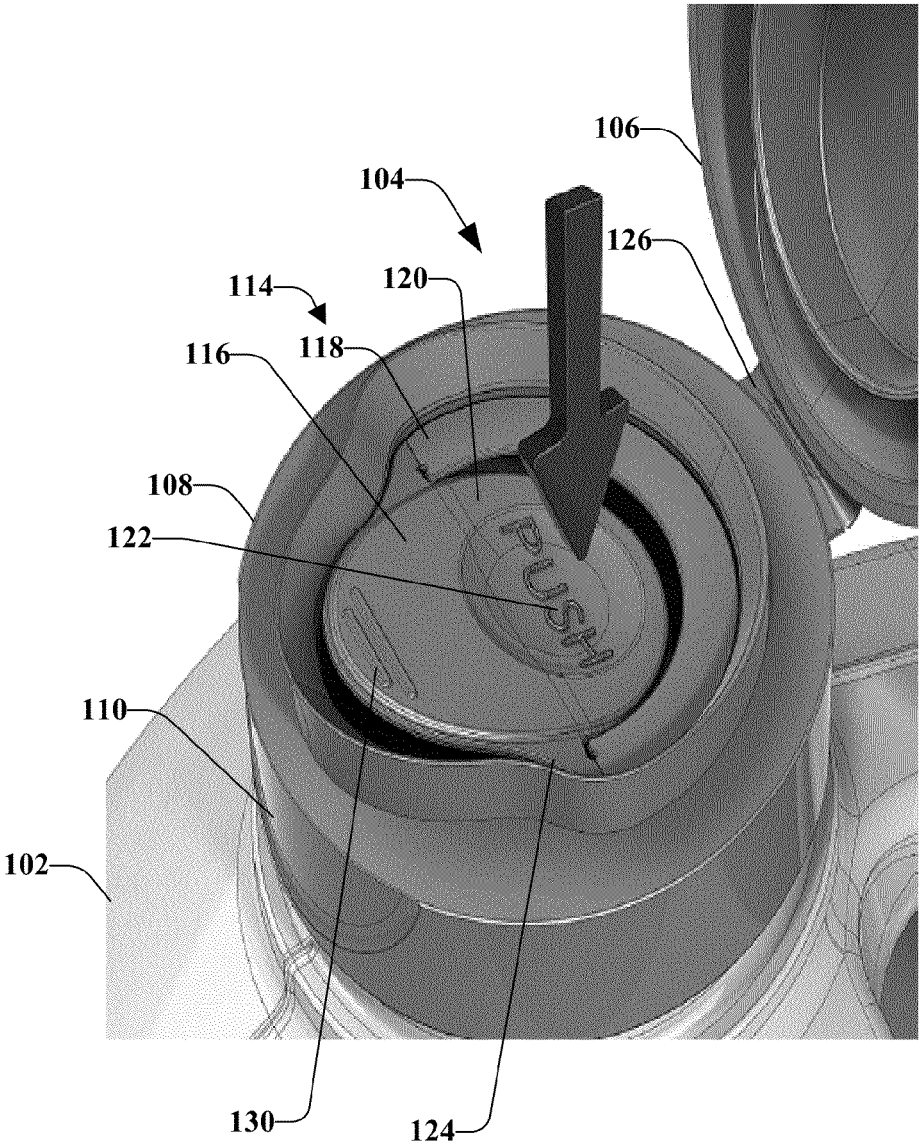
FIG. 3 illustrates an example, non-limiting embodiment of a main portion of a dispensing closure; according to an aspect.

With reference now to FIGS. 1-3, a tamper evident seal 114 can be attached to the main portion 108. For example, in FIGS. 1-3, the seal has not been completed removed from the dispensing closure. Before removal of the tamper evident seal 114, the container can be hermetically sealed, which can be useful for liquid products, medical products, and so on. However, it is not necessary for the container to be hermetically sealed.

The tamper evident seal 114 can comprise a push tab 116 and a tether portion 118. The location of the push tab 116 can be at about a center of an opening of the main portion 108. However, according to some aspects, the location of the push tab 116 can be offset from the center of the opening, placed at a side of the opening, or placed at another location relative to an orientation of the opening. The selection of the location for the push tab 116 can be based on various design considerations including, but not limited to, a shape and/or size of the dispensing closure and/or the amount of material used to form the tamper evident seal 114.

Another consideration can include the size of the tamper evident seal 114. For example, although various aspects are illustrated and described as a tamper evident seal that is removed to expose an opening that is about the same size as the mouth of the container, the disclosed aspects are not limited to this implementation. Instead, the tamper evident seal might be smaller than the size of the mouth of the container, wherein at least a portion of the mouth of the container is covered by material of the dispensing closure that is located over the mouth of the container. The opening of the main portion 108 can correspond with a mouth of the container portion 102. The opening can be about the same size as the mouth of the container or can be sized to be smaller than the size of the mouth of the container.

In an implementation, a dispensing closure might comprise two or more push tabs and tether portions (e.g., two or more tamper evident seals). For example, for a large dispensing closure (and associated container), it might be beneficial to provide multiple tamper evident seals for ease of opening (e.g., reducing the amount of material removed with each seal, reducing the amount of force necessary to remove the seal, and so forth). For example, two tamper evident seals might be adjacent each other (contiguous) such that removal of both seals provides for a continuous opening without material remaining therebetween.

In another example, a container might contain multiple contents (e.g., salt and pepper). Thus, the container might be divided into two (or more) sections; one section for salt and one section for pepper, in this example. According to this example, the two tamper evident seals are non-contiguous such that there is material located between the two tamper evident seals. The material is not intended to be removed when the two tamper evident seals are removed. Therefore, the dispensing closure might have two separate tamper evident seals, which are configured to control a size and location of the openings independently. Continuing the above example, the flip-top portion of the dispensing closure might have multiple flaps, wherein a first flap is opened to allow the salt to be dispensing and a second flap is opened to allow the pepper to be dispensed.

The push tab 116 can comprise a first end 120 comprising a push portion 122 that has a dimpled area (or slightly indented area) that extends downward, toward the container portion 102 (e.g., in a direction away from the flip-top portion 106). According to an implementation, the push portion 122 does not have a dimpled area, but has a surface area that is even (e.g., on the same plane) with the other portions of the tamper evident seal 114. In accordance with some implementations, the push portion 122 comprises wording (e.g., "PUSH") to instruct the user how to open the tamper evident seal 114. According to some implementations, different wording than that illustrated can be utilized. For example, the different wording can be different words (e.g., press, down, and so on) and/or different languages can be used. In some implementations, no instructions (e.g., no words) are provided. According to some implementations, visual cues are provided instead of words. For example, a pictorial representation of a thumbprint or finger print at the point where downward force should be applied is provided.

The push tab 116 can also comprises a second end 124 operatively attached to the tether portion 118 (or trailing member). As illustrated, the second end 124 can be located at a side of the dispensing closure 104 (e.g., relative to a hinge 126). However, according to some aspects, the second end 124 can be located at any place relative to the tamper evident seal 114. For example, the second end 124 can be located near the hinge 126 area, at a location that is substantially 180 degrees from the placement shown, at a position 90 degrees away from the hinge 126 area, at a position 30 degrees away from the hinge, or any another location.

The tether portion 118 can comprises at least one ring or rib. According to an implementation, the at least one rib comprises a spiral element that at least partially encloses at least a portion of the push tab 116. In an aspect, the at least one rib comprises a spiral element that at least partially encircles the push tab 116 at least once. According to another aspect, the at least one rib comprises a spiral element that at least partially surrounds the tab at least twice. According to an implementation, the spiral element can at least partially surround the push tab 116 once in a first direction and can at least partially surround the push tab 116 a second time in a second direction. For example, the spiral element can partially surround the tab in a counter clockwise direction and, when the tab is almost surrounded by the spiral element, the spiral element can change direction, and partially surround the tab in a clockwise direction. In another example, the spiral element can partially surround the tab in a clockwise direction and, when the tab is almost surrounded by the spiral element, the spiral element can change direction and partially surround the tab in a counter clockwise direction. However, according to another implementation, the spiral element can encircle the tab at least twice in a same direction (e.g., the rings are formed in a clockwise direction around the tab, the rings are formed in a counter clockwise direction around the tab).

In an implementation, the spiral element can at least partially surround the tab a first time at an outer edge of an opening of the dispensing closure. Further, the spiral element can at least partially surround the tab a second time, wherein the spiral element is located between the tab and the spiral element that partially surrounded the tab the first time. In another implementation, the spiral element can at least partially surround the tab a first time at an inner location, near the tab. Further to this implementation, the spiral element can at least partially surround the tab a second time, wherein both the tab and the spiral element that at least partially surrounded the tab a first time are enclosed within the spiral element.

Figure 4:
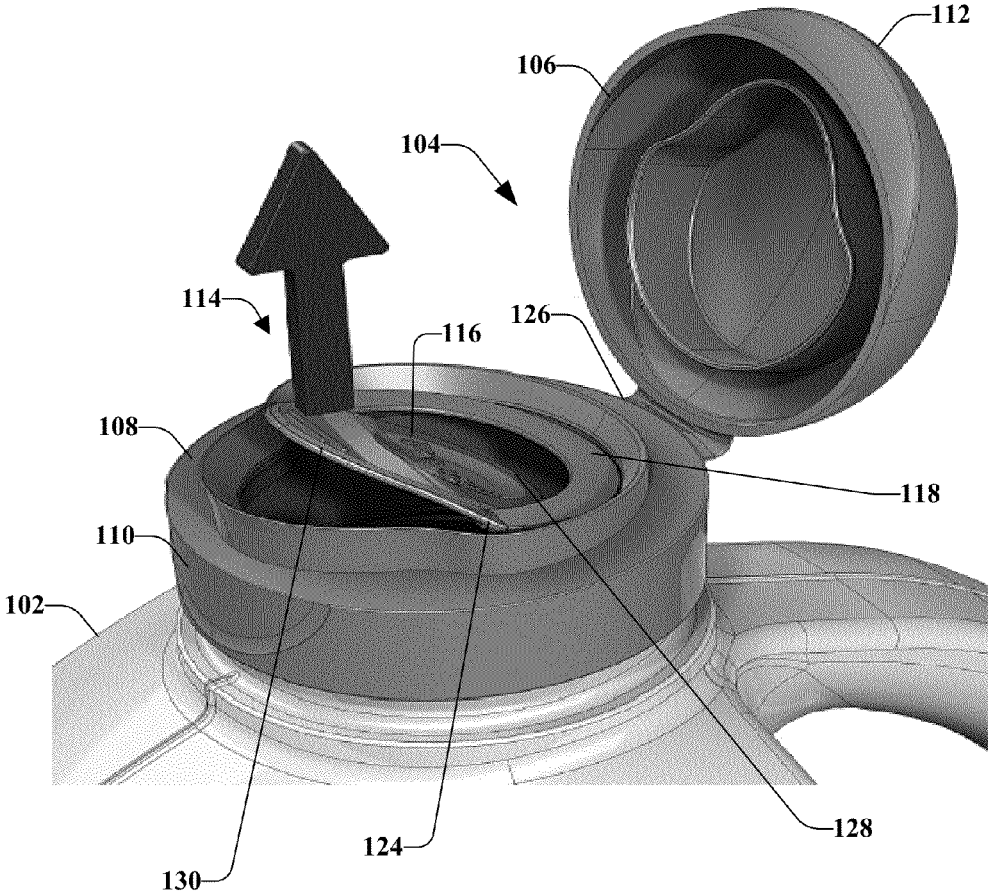
FIG. 4 illustrates an example, non-limiting embodiment of removal of a tamper evident seal, according to an aspect.

As stated previously, as illustrated in FIG. 1, the tamper evident seal 114 of the dispensing closure 104 has not been opened (e.g., the container contents have not been accessed through the dispensing closure 104). In order to open the container and gain access to the container contents (without removing the dispensing closure, if removable), the push tab 116 can be configured to break at least partially away from the tether portion 118 (or at least one rib) as a result of downward force applied to the push tab 116. For example, as illustrated by the directional arrow of FIG. 2, pressure applied in a downward direction (e.g., in a direction toward the container portion 102) on the push tab 116 can cause the push tab 116 to break (or snap) away from one or more portions of the tether portion 118. This in turn can cause the tamper evident seal to break. FIG. 3 illustrates a close-up view of the main portion 108. As illustrated in FIG. 4, pressing down on a back portion 128 of the push tab 116 can cause a front portion 130 of the push tab 116 to raise upward away from the container assembly 102 (as indicated by the directional arrow in FIG. 4). It is noted that although various terms such as "back", "front", "upward", "downward", or the like are used herein, it is to be understood that the relationship between the position, location, and/or direction of the various features are not to be limited to these terms. Instead, such terms are utilized for description purposes only.

After the push tab 116 is broken, at least partially, away from the tether portion 118, the push tab 116 can be pulled in an upward direction, away from the main portion 108 as indicated by the directional arrow of FIG. 4. Pulling the push tab 116 in the upward direction can cause the push tab 116 and the tether portion 118 to move out of the opening (e.g., away from the dispensing closure 104). Continued movement of the push tab 116 in the upward direction can cause the push tab 116 to spiral along the ribs or tether portion 118. Thus, the tether portion 118 (or at least one rib) can be configured to spiral, at least partially, away from the push tab 116 and the main portion 108 when the push tab 116 is pulled in an upward direction away from the main portion 108.

Figure 5:
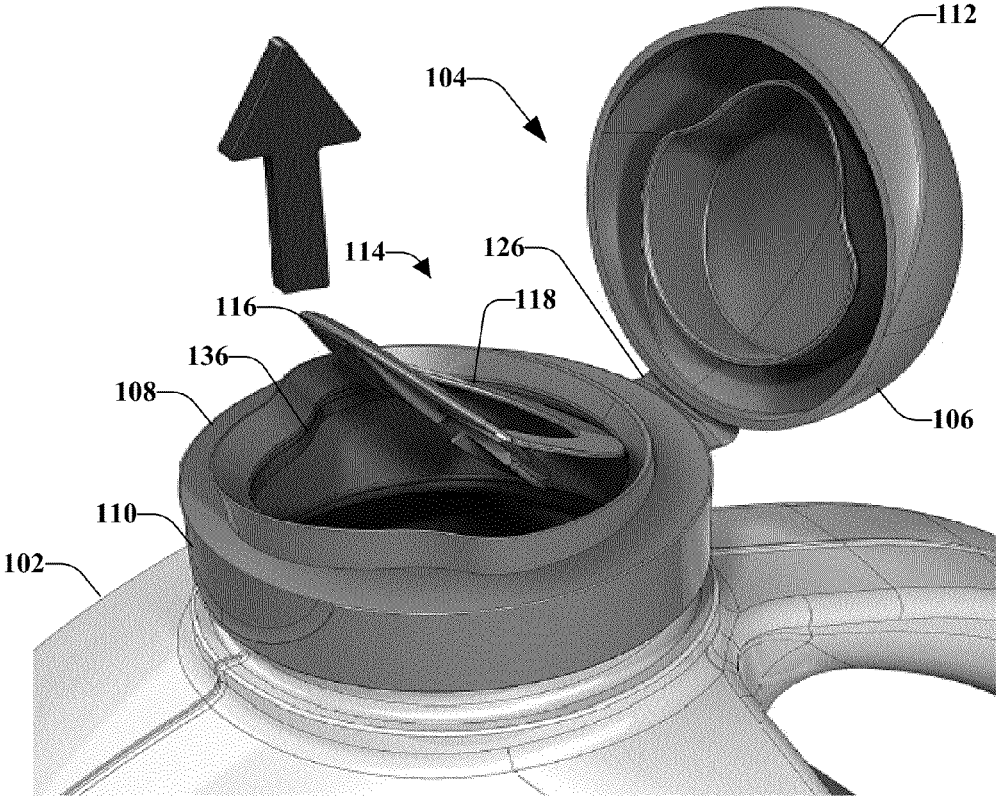
FIG. 5 illustrates an example, non-limiting embodiment of continuing removal of the tamper evident seal of FIG. 4, according to an aspect.
Figure 6:
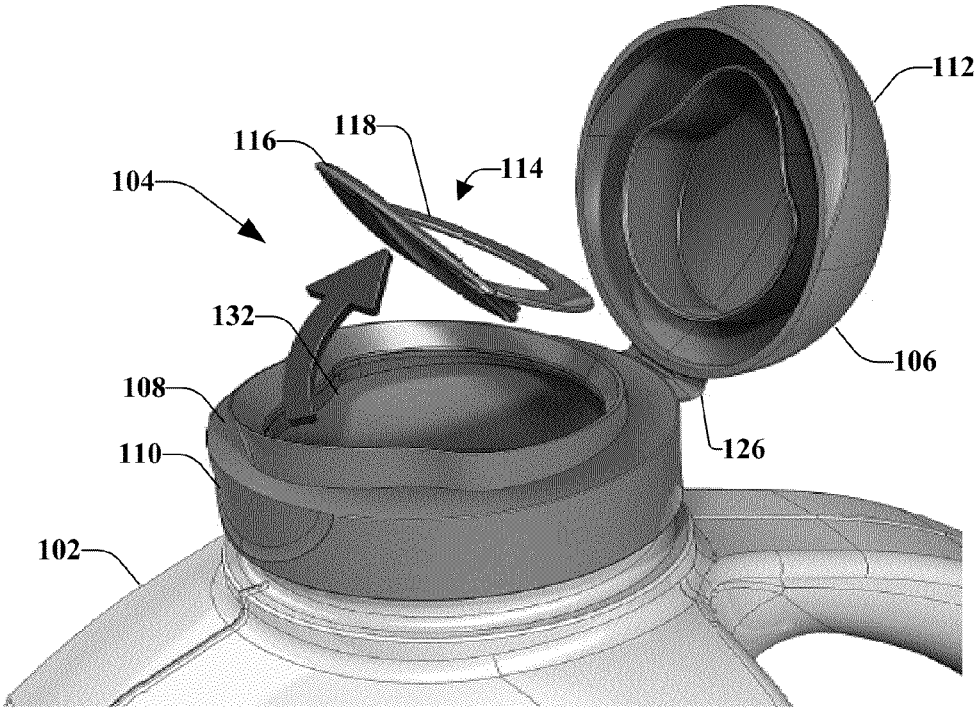
FIG. 6 illustrates an example, non-limiting embodiment of complete removal of the tamper evident seal of FIG. 4, according to an aspect.
Figure 7:
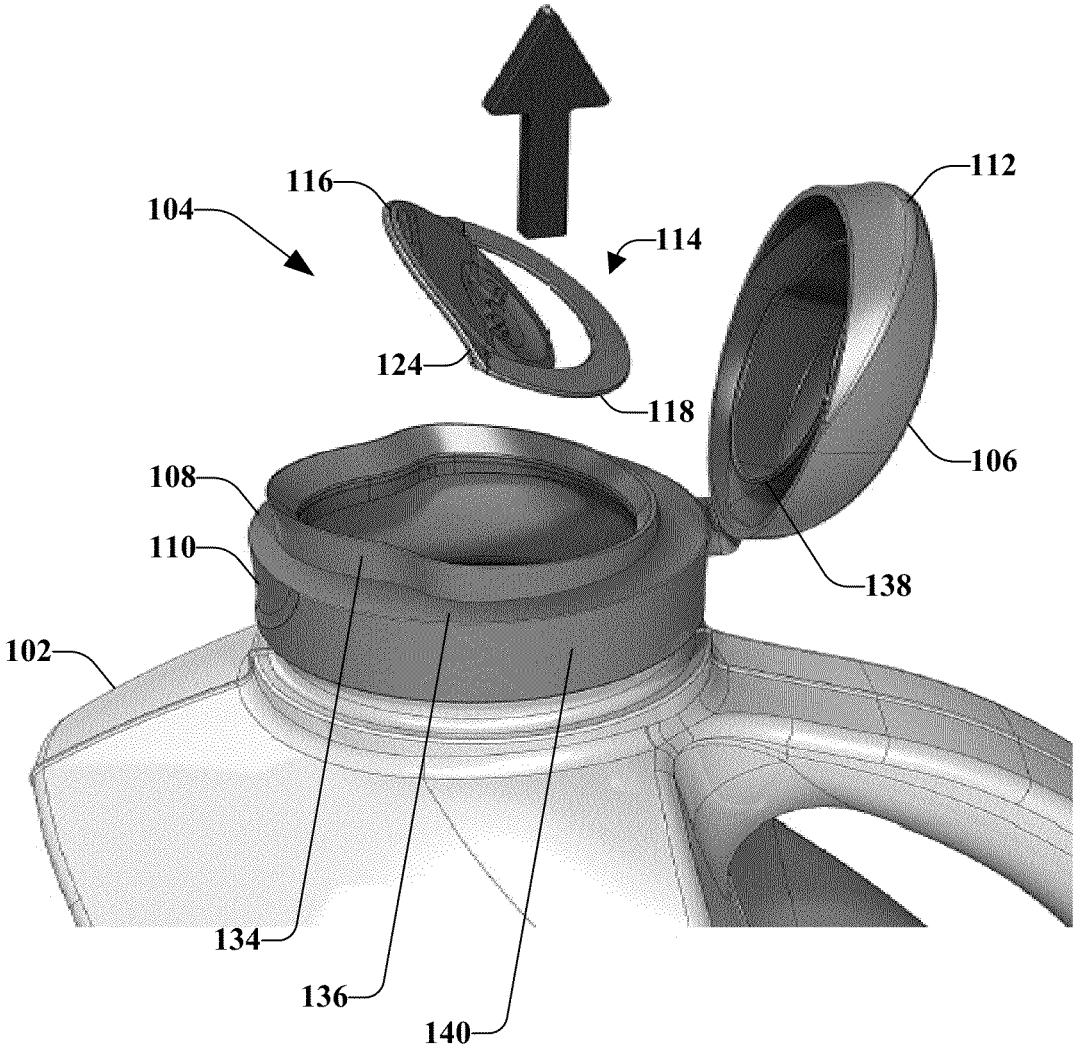
FIG. 7 illustrates another example, non-limiting embodiment of complete removal of the tamper evident seal of FIG. 4, according to an aspect.

This movement causes the tether portion 118 to tear away from the inside of the opening of the dispensing closure 104, as illustrated in FIG. 5. After the push tab 116 and tether portion 118 have been removed from the dispensing closure 104, as illustrated in FIG. 6 and FIG. 7, the push tab 116 and tether portion 118 can be disposed of, such as by recycling the removed portions. The push tab 116 and the tether portion 118 (e.g., at least one rib) are irreversibly removed from the main portion 108. Thus, once removed, the push tab 116 and the tether portion 118 are not re-attachable to the main portion 108. Therefore, if the tamper evidence seal is compromised (e.g., someone attempts to gain access to the container contents through the dispensing closure), the tab and/or portions of the tether portion would need to be removed (or broken away) from the main portion, which can be easily ascertained by viewing the tamper evidence seal.

In accordance with some aspects, the dispensing closure 104 is non-removable from the container portion 102. According to other aspects, the dispensing closure 104 is removable from the container portion 102 and at least a portion of the dispensing closure 104 and/or container portion 102 can be wrapped in plastic or other material (e.g., shrink-wrapped) to provide further tamper evidence capabilities.

In accordance with some aspects, the container portion 102, the flip-top portion 106, the main portion 108, or combinations thereof, can be made of the same material or of a similar material. In some aspects, the container portion 102, the flip-top portion 106, the main portion 108, or combinations thereof, can be formed of different materials. According to some aspects, the container portion 102, the flip-top portion 106, the main portion 108, or combinations thereof, can be formed of an injection molded suitable thermoplastic material (e.g., polymer, polypropylene, and so forth) or other material known in the art.

In accordance with some aspects, the container portion 102, the flip-top portion 106, the main portion 108, or combinations thereof, can be formed with clear or transparent material, which can allow for viewing of the container contents. For example, one or more portions can be formed of clear polypropylene. However, according to other aspects, one or more portions can be formed of a colored material or a non-transparent material or different colored materials. For example, the flip-top portion 106 can be formed of a material having a first color and the main portion 108 can be formed of a material having a second color. Further, the one or more portions can be formed of any number of different combinations of clear or transparent material and/or colored or non-transparent material. For example, the container assembly 100 can be formed of both clear material and colored material (e.g., the container portion 102 is formed of clear material and the dispensing closure 104 is formed of colored material, or vice versa).

Figure 8:
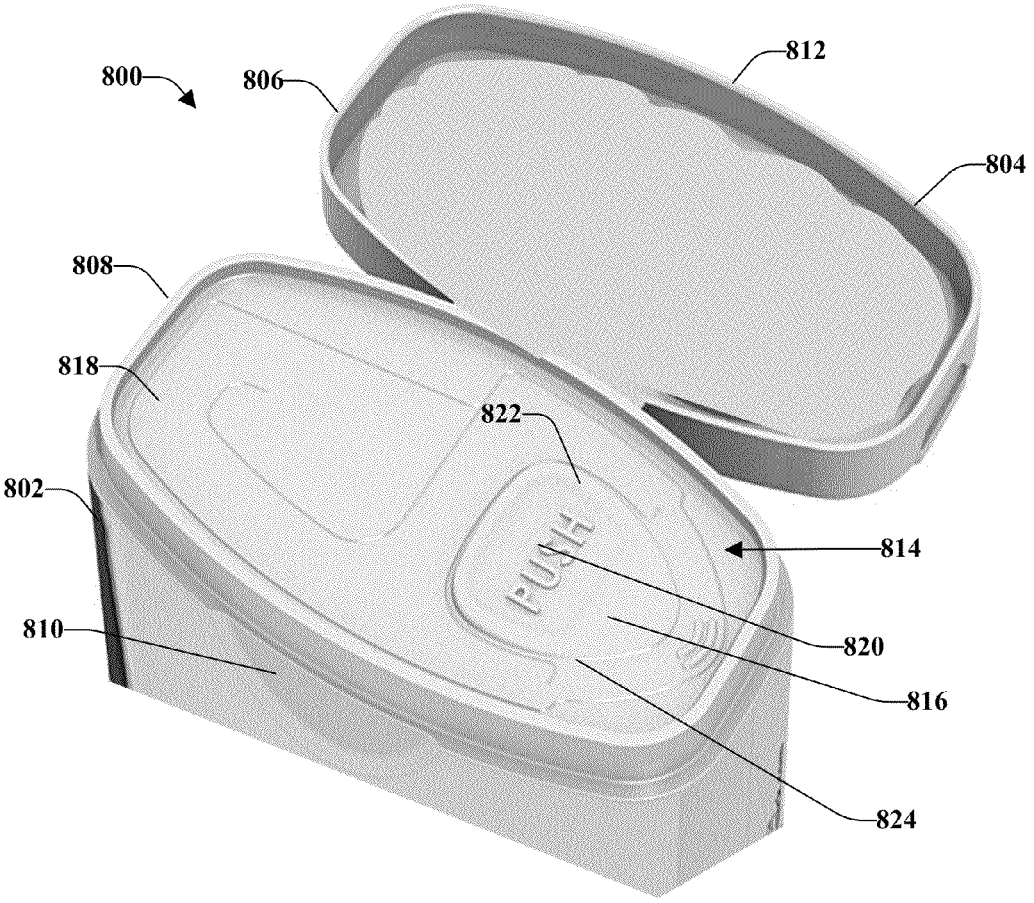
FIG. 8 illustrates another example, non-limiting embodiment of a container assembly, according to an aspect.

Further, the flip-top portion 106 and the main portion 108 can be a unitary or a one-piece structure, as illustrated in FIG. 8. In accordance with some aspects, the flip-top portion 106 and the main portion 108 can comprise a two-piece structure. It should be noted that although the various aspects are illustrated as a generally circular flip-top portion 106 and main portion 108, the various aspects are not limited to this implementation. In accordance with some aspects, the flip-top portion 106 and the main portion 108 can have a different geometric shape (e.g., oval, oblong, rectangular, square, irregular, and so on). For example, the geometric shape of the flip-top portion 106 and the main portion 108 can correspond to the shape of a mouth or spout of the container portion 102.

The flip-top portion 106 can be pivotally joined to the main portion 108 by, for example, a hinge 126. The hinge 126 can be configured to mitigate cracks that might develop at or along one or more flex portions of the hinge 126. For example, the hinge 126 can be constructed of a relatively thin wall that is configured to flex without breakage during an expected service life of the dispensing closure 104. For example, the hinge 126 can be formed of a material that has at least some flexibility and/or that can deform slightly or significantly in order to mitigate cracking and/or breakage of the hinge 126. In accordance with some aspects, the hinge 126 can be formed with the same or similar material as the main portion 108 and/or the flip-top portion 106. In other aspects, the hinge 126 can be formed of a material that is different than the material used to form the main portion 108 and/or the flip-top portion 106.

The hinge can be a "living hinge", a "pivoting hinge", or another type of hinge. A living hinge is a hinge formed with the main portion 108 and the flip-top portion 106 as a single piece. A living hinge can be configured to facilitate the flip-top portion 106 being able to spring away from the main portion 108 when access to the container contents is desired. A pivoting hinge can be formed at substantially the same time as the body portion (or the lid portion), wherein the body portion and the lid portion are formed as separate pieces and snapped together at the hinge to combine the two pieces into a single dispensing closure assembly.

The hinge 126 lies in a plane perpendicular to the axis of an opening or mouth of the container portion 102. The hinge 126 can also provide ease of moving the flip-top portion 106. For example, the hinge 126 can operatively connect the flip-top portion 106 to the main portion 108 in a movable arrangement, wherein the flip-top portion 106 comprises at least two positions, namely, a first position and a second position. When in the first position, the flip-top portion 106 is "open" (or moved away from the main portion 108), which allows product to be placed into the container portion 102 and/or dispensed from the container portion 102. When the flip-top portion 106 is in the second position, the flip-top portion 106 is closed or engaged with the main portion 108, providing a secure and leak proof seal according to various aspects disclosed herein. Thus, the hinge 126 allows the flip-top portion 106 to be moved away from the main portion 108 (e.g., flipped up, placed into first position) for dispensing and/or for filling. The hinge 126 can allow the flip-top portion 106 to be moved into contact with the main portion 108 (e.g., placed into the body position) for storage, transport purposes, and/or for other purposes.

The flip-top portion 106 can be installed upright on the top of the main portion 108 that has an opening 132 that lies in a horizontal plane. For purposes of discussion, the vertical direction generally corresponds to an axial direction with reference to the geometry of the container (comprising the main portion and the flip-top portion) and the horizontal direction or horizontal plane is perpendicular to the axial direction of the container (e.g., the vertical direction). It should be understood that during fabrication, molding, shipping, storage, and so forth, the main portion and/or flip-top portion could have a non-upright orientation.

It is also noted that although the dispensing closure 104 is illustrated (e.g., in FIG. 7) as having a raised portion or raised wall 134 located around the tamper evident seal 114, the disclosed aspects are not limited to this embodiment. For example, according to some embodiments a surface area 136 of the dispensing closure can be flush with the tamper evident seal 114 (e.g., there is no raised wall 134). In a similar manner, although the flip-top portion 106 is illustrated as comprising an internal wall 138 that is complementary to the raised wall 134 of the main portion 108, the disclosed aspects are not limited to this embodiment. For example, the flip top portion might not comprise an internal wall 138 according to an aspect.

The surface area is operatively attached to a downward extending skirt 140 that can comprise internal threads for engagement with a top portion of the container assembly 102.

However, according to some implementations, the skirt 140 does not have internal threads.

FIG. 8 illustrates an example, non-limiting embodiment of a container assembly 800 that is non-circular. It is noted that similar element numbers as the previous figures are used for this figure for purpose of explaining the disclosed aspects. Further, various aspects of the container assembly 800 are similar to the container assembly 100 described with reference to the above figures and, therefore, will not be repeated here.

Container assembly 800 includes a container portion 802 and a dispensing closure 804. It is noted that the wording on the container portion 802 and/or the dispensing closure 804 is for illustration purposes only.

As indicated, the main portion 802 of the dispensing closure 804 is integrated with the container portion 802 (e.g., the container and the dispensing closure are molded as a one piece unit). The container portion 802 can be hollow, which allows product to be placed within the container portion 802.

Dispensing closure 804 can include a lid portion or flip-top portion 806 and a main portion 808. An indented area 810 on the main portion 808 corresponds with a thumb tab 812 on the flip-top portion 806. Further, a tamper evident seal 814 can be attached to the main portion 808. The tamper evident seal 814 can comprise a push tab 816 and a tether portion 818. As illustrated, the push tab 816 can be located off center of the opening of the main portion 808. The push tab 816 can comprise a first end 820 comprising a push portion 822 that has a slightly dimpled area. The push tab 816 can also comprise a second end 824 operatively attached to the tether portion 818 (or trailing member).

As illustrated, the tether portion 818 can comprise at least one ring or rib. According to an implementation, the at least one rib comprises a spiral element that at least partially encloses at least a portion of the push tab 816. Further, the tether portion 818 is configured to fill a remaining portion, over the opening of the container portion 808, with material to seal the contents within the container portion 802. The tamper evident seal 814 can be removed from the dispending closure 804 similar to the manner described with references to the above figures and, therefore, will not be repeated here.

Figure 9:
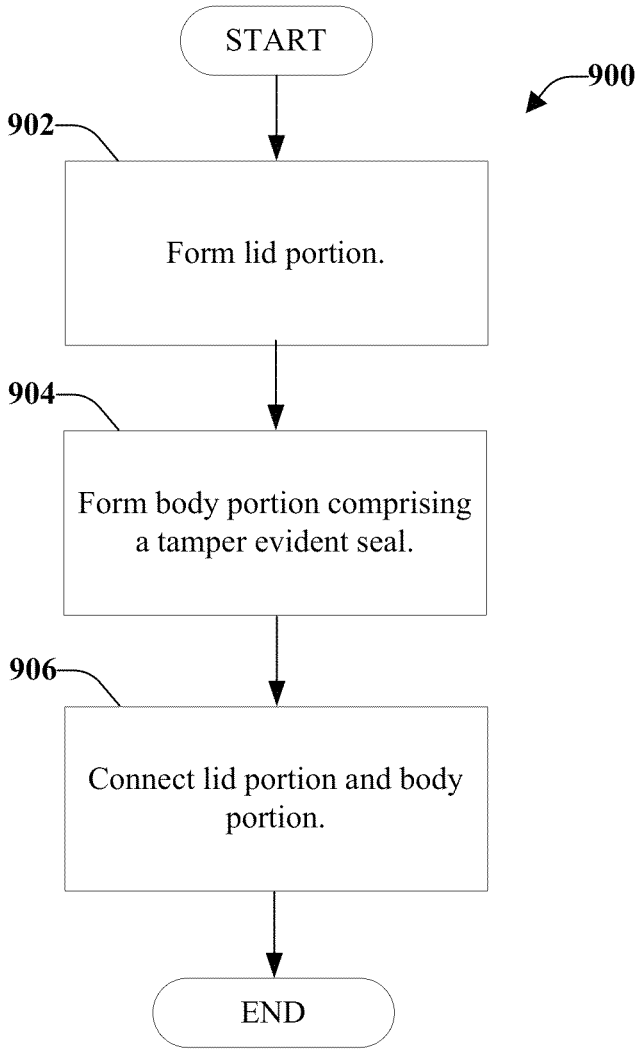
FIG. 9 illustrates an example, non-limiting method for fabricating a container cap comprising a tamper evident seal, according to an aspect.

FIG. 9 illustrates an example, non-limiting method 900 for fabricating a container cap comprising a tamper evident seal, according to an aspect. Method 900 can provide a dispensing closure that does not utilize a separate tamper evident liner. The dispensing closure can be leak proof and can provide for ease of opening the container to access contents contained within the container. For example, a tamper evident seal integrated with the dispensing closure can be easily removed, which can facilitate usage of the container by persons with hand problems (e.g., arthritis, hand deformations, missing fingers and/or thumbs, and so forth). The dispensing closure can also comprise a flip-top portion, which provides ease of opening and closing of the dispensing closure. Further, the opening and closing of the dispensing closure can be performed with one hand.

Method 900 starts, at 902, when a lid portion of a dispensing closure is formed. At 904, a body portion of the dispensing closure is formed. The body portion comprises an integrated tamper evident seal. For example, forming the body portion can include forming a push tab comprising an attached tether portion. According to an aspect, the push tab can be located at or around a center of the body portion (e.g., at or around an opening of the body portion).

According to another aspect, forming the body portion comprises forming a spiral tab that includes portions formed of thin sections of material. For example, the push tab and tether portion can be formed of a material that comprises a first thickness and portions of the tamper evident seal that define the tab and tether portion can be formed of a material that comprises a second thickness. Thus, the tab and tether portion can be formed of material that has a relatively thick wall and the other portions can be formed of a material (which can be the same material, such as thermoplastic material) that has a relatively thin wall. It is noted that the relationship between thickness and the width of each portion, and the size ratio between the portions, for instance, are not necessarily identical to those in reality. Furthermore, the same portion may be shown with different dimensions or ratios depending on the figures.

For example, thin portions of material can be utilized to define a spiral element and can facilitate forming the spiral element to at least partially surround the tab at least once. Further, using thinner material to define (e.g., border) the spiral element and the tab can facilitate breakage or tearing of the tab and/or spiral element away from the main portion. Additionally, the use of thinner material can provide leak-proof capabilities since there is material (having a thin wall) that retains the product (e.g., liquid, powder, and so forth) within the container during shipment, for example.

According to some aspects, instead of using thinner material to define the tab and/or the tether portion, the respective portions of the tamper evident seal are devoid of material. For example, gaps or breaks in the material can occur in order to define the tab and/or tether portion and to provide ease of removal of the tamper evident seal.

The lid portion is connected to the body portion, at 906. For example, the lid portion and body portion can be connected by a hinge. For example, the hinge can be a living, a pivoting hinge, or another type of hinge.

Figure 10:
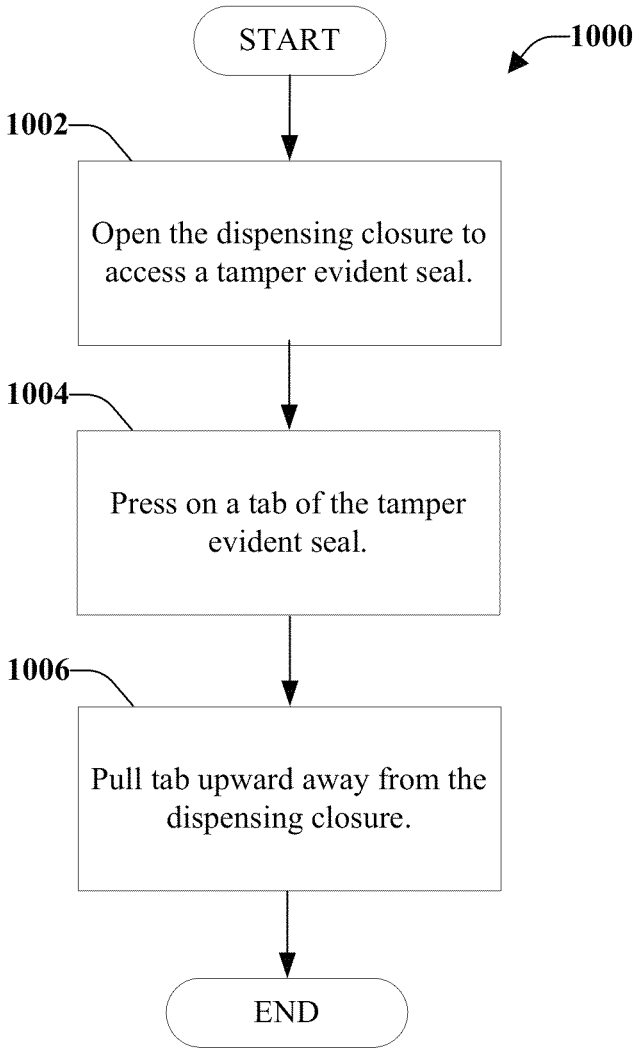
FIG. 10 illustrates an example, non-limiting method for removing a tamper evident seal, according to an aspect.

FIG. 10 illustrates an example, non-limiting method 1000 for removing a tamper evident seal, according to an aspect. At 1002, a dispensing closure is opened. For example, opening the dispensing closure can include pushing up on a thumb tab in order to open a lid of the dispensing closure. Opening the dispensing closure exposes a tamper evident seal integrated with the dispensing closure.

At 1004, a center tab of the dispensing closure is pressed on. The pressure applied to the tab can be in a downward direction. Pressing on the tab can cause one or more portions of the tamper evident seal to snap or break away from each other and from the dispensing closure. For example, the tab can break away from a trailing member attached to the tab. In another example, the trailing member can partially surround the tab in one or more directions (e.g., spiral around the tab). Pressing on the tab can cause the spirals of the trailing member to break away from the tab, the dispensing closure, and other portions of the trailing member. Further, pressing on the push tab can cause a first portion of the tab to move downward and a second portion of the tab to move upward.

The tab can be pulled up and out (away from) the dispensing closure, at 806. Pulling the tab upward, away from the dispensing closure causes the tab to spiral, along the trailing member, and tear away from the inside of the container spout. The tamper evident seal is irreversibly removed from the dispensing closure and can be disposed, such as by recycling.

As discussed herein, provided is a container assembly that comprises a container and a dispensing closure. The dispensing closure comprises a skirt configured to operatively engage a neck portion of the container. The dispensing closure also comprises a body portion operatively attached to the container. The body portion comprises a movable element that indicates evidence of product tampering. Further, the dispensing closure comprises a lid portion operatively attached to the body portion at a hinge and configured to move away from the body portion when product is to be dispensed from the container.

In an implementation, the movable element comprises a tab member in removable engagement with the body portion. According to another implementation, the movable element comprises a tab having a first end comprising a protrusion that extends away from the body portion and toward the lid portion and a second end operatively attached to a trailing member that at least partially surrounds the tab. In accordance with a further implementation, the movable element is configured to disengage from the body portion to enable access to contents of the container.

According to some aspects, disengagement of at least a portion of the movable element from the body portion is indicative of product tampering. In accordance with some aspects, the movable element is non-reusable. Further, according to various aspects, the movable element comprises a tether attached to a pull tab.

While the foregoing disclosure discusses illustrative aspects and/or embodiments, it should be noted that various changes and modifications could be made herein without departing from the scope of described aspects and/or embodiments as defined by the appended claims. Accordingly, described aspects are intended to embrace all such alterations, modifications, and variations that fall within the scope of the appended claims. Furthermore, although elements of described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise.

While, for purposes of simplicity of explanation, methods may be shown and described as a series of blocks, it is to be understood and appreciated that the claimed subject matter is not limited by the number or order of blocks, as some blocks may occur in different orders and/or at substantially the same time with other blocks from what is depicted and described herein. Moreover, not all illustrated blocks may be required to implement methods described herein. It is to be appreciated that functionality associated with blocks may be implemented by software, hardware, a combination thereof or any other suitable means (e.g. device, system, process, component, controller, injection molding machinery, and so on). Additionally, it should be further appreciated that methods disclosed throughout this specification are capable of being stored on an article of manufacture to facilitate transporting and transferring such methods to various devices. Those skilled in the art will understand and appreciate that a method could alternatively be represented as a series of interrelated states or events, such as in a state diagram.

To the extent that the term "includes" is used in either the detailed description or the claims, such term is intended to be inclusive in a manner similar to the term "comprising" as "comprising" is interpreted when employed as a transitional word in a claim. Furthermore, the term "or" as used in either the detailed description or the claims is intended to mean an inclusive "or" rather than an exclusive "or". That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Additionally, in the subject description, the word "exemplary" (and variants thereof) is used to mean serving as an example, instance, or illustration. Any aspect or design described herein as "exemplary" is not necessarily to be construed as preferred or advantageous over other aspects or designs. Rather, use of the word "exemplary" is intended to present concepts in a concrete manner.

What is claimed is:

1. A closure, comprising:

a main portion comprising a tab and at least one rib; and a flip-top portion operatively connected to the main portion and movable with respect to the main portion, wherein the tab and the at least one rib are irreversibly removable from the main portion;

wherein the tab comprises a first end, a second end, and a tether portion, the first end removably attached to the tether portion, and the second end operatively attached to the tether portion, wherein the tab is configured such that a force applied to the first end in a first direction towards the container causes the second end to move in a second direction away from the container.

2. The closure of claim 1, wherein a location of the tab is at about a center of an opening of the main portion, wherein the opening of the main portion corresponds with a mouth of a container.

3. The closure of claim 1, wherein the at least one rib comprises a spiral element that at least partially encloses at least a portion of the tab.

4. The closure of claim 1, wherein the at least one rib comprises a spiral element that at least partially encircles the tab at least once.

5. The closure of claim 1, wherein the at least one rib comprises a spiral element that at least partially surrounds the tab at least twice.

6. The closure of claim 1, wherein the at least one rib is configured to spiral partially away from the tab and the main portion when the tab is pushed in a downward direction toward the main portion.

7. The closure of claim 1, wherein the tab and the at least one rib comprise a tamper evident seal.

8. A method for fabricating a container cap, comprising:

forming a lid portion;

forming a body portion comprising an integrated tamper evident seal, wherein the integrated tamper seal comprises a first end, a second end, and a tether portion, the first end removably attached to the tether portion, and the second end operatively attached to the tether portion, wherein the integrated tamper seal is configured such that a force applied to the first end in a first direction towards a container causes the second end to move in a second direction away from the container; and connecting the lid portion and the body portion.

9. The method of claim 8, wherein the forming the body portion comprises creating a spiral tab on an interior section of the body portion.

10. The method of claim 8, wherein the forming the body portion comprises forming a spiral tab including portions formed of thin sections of material.

11. A container assembly, comprising:

a container;

a dispensing closure comprising:

a skirt configured to operatively engage a neck portion of the container;

a body portion operatively attached to the container, wherein the body portion comprises a movable element that indicates evidence of product tampering, wherein the movable element comprises a first end, a second end, and a tether portion, the first end removably attached to the tether portion, and the second end operatively attached to the tether portion, wherein the moveable element is configured such that a force applied to the first end in a first direction towards the container causes the second end to move in a second direction away from the container; and a lid portion operatively attached to the body portion at a hinge and configured to move away from the body portion when product is to be dispensed from the container.

12. The container assembly of claim 11, wherein the container and the dispensing closure are molded as a one piece unit.

13. The container assembly of claim 11, wherein the movable element is in removable engagement with the body portion.

14. The container assembly of claim 11, wherein disengagement of at least a portion of the movable element from the body portion is indicative of product tampering.

15. The container assembly of claim 11, wherein the movable element is non-reusable.

16. The closure of claim 1, further comprising a second tab having a first end, a second end, and a tether portion, the first end removably attached to the tether portion, and the second end operatively attached to the tether portion.

17. The closure of claim 16, wherein the tab is adjacent to the second tab.

18. The method of claim 8, wherein respective portions of the tamper evident seal are devoid of material.

19. The assembly of claim 11, wherein the first end has an indented area that extends toward the container.

* * * * *